US008196233B1

(12) United States Patent
Daniels

(10) Patent No.: US 8,196,233 B1
(45) Date of Patent: Jun. 12, 2012

(54) HEIGHT ADJUSTABLE TOILET STAND DEVICE

(75) Inventor: William L. Daniels, Orangeburg, SC (US)

(73) Assignee: William L Daniels, Orangeburg, SC (US)

( * ) Notice: Subject to any disclaimer, the term of this patent is extended or adjusted under 35 U.S.C. 154(b) by 0 days.

(21) Appl. No.: 13/170,761

(22) Filed: Jun. 28, 2011

(51) Int. Cl.
*E03D 11/00* (2006.01)

(52) U.S. Cl. ..... 4/420; 4/252.1

(58) Field of Classification Search ..... 4/252.1–252.6, 4/667, 420, 645; 182/141
See application file for complete search history.

(56) References Cited

U.S. PATENT DOCUMENTS

| | | | | |
|---|---|---|---|---|
| 3,267,882 | A * | 8/1966 | Rapson et al. | 108/51.11 |
| 3,456,264 | A * | 7/1969 | Flagg | 4/645 |
| 4,091,473 | A * | 5/1978 | Matthews et al. | 4/420 |
| 4,174,546 | A | 11/1979 | Ohtake | |
| 4,392,260 | A * | 7/1983 | Bensen | 4/324 |
| 4,441,218 | A * | 4/1984 | Trybom | 4/252.2 |
| 4,657,112 | A * | 4/1987 | Ream et al. | 182/69.4 |
| 4,726,079 | A * | 2/1988 | Signori et al. | 4/420 |
| 5,027,446 | A | 7/1991 | Robertson | |
| 5,031,251 | A | 7/1991 | Williams et al. | |
| 5,199,113 | A * | 4/1993 | Glasow et al. | 4/252.2 |
| 5,446,928 | A * | 9/1995 | Daniels | 4/434 |
| 6,477,725 | B1 * | 11/2002 | Hong et al. | 4/645 |
| 6,553,582 | B1 * | 4/2003 | Clark | 4/252.2 |
| 6,643,861 | B2 * | 11/2003 | Sherlock et al. | 4/560.1 |
| 6,745,417 | B2 * | 6/2004 | Sumino | 4/662 |

FOREIGN PATENT DOCUMENTS

JP 03047340 A * 2/1991

* cited by examiner

*Primary Examiner* — Gregory Huson
*Assistant Examiner* — Janie Christiansen

(57) ABSTRACT

The height adjustable toilet stand device provides for accommodating individuals of varying heights. Importantly, the housings are designed to fit typical toilet dimensions such that the front and back sides of the housing are substantially even with a front and back of a toilet. A user is thereby allowed feet placement adjacent to the toilet. In order for the device to correctly accommodate shorter statures, the bottom housing is ideally sunken within a given surface such that the toilet begins, without elevation, at a height even with the surface. The individual of greater stature has only to turn on the on/off and then use the up/down control to select a desired height for the toilet. This adjustable height feature is not only important for convenience but may be of key importance to anyone suffering from physical limitations.

3 Claims, 4 Drawing Sheets

HEIGHT ADJUSTABLE TOILET STAND DEVICE

BACKGROUND OF THE INVENTION

The ease of bending and sitting a toilet is determined by a person's size, or height if you will. Toilet heights are designed for the average height person, which ranges from about 5'9" for males to about 5'5" for females. Those of lesser or great height can be at significant disadvantage with regard to toilet accessibility and comfort, especially if any physical limitations exist. The present device provides for adjustment of a toilet's height so that a myriad of individual heights can be accommodated.

FIELD OF THE INVENTION

The height adjustable toilet stand device relates to toilets and more especially to a toilet stand that adjusts to selectively choose a toilet's height for use by a myriad of varied height individuals.

SUMMARY OF THE INVENTION

The general purpose of the height adjustable toilet stand device, described subsequently in greater detail, is to provide a height adjustable toilet stand device which has many novel features that result in an improved height adjustable toilet stand device which is not anticipated, rendered obvious, suggested, or even implied by prior art, either alone or in combination thereof.

To attain this, the height adjustable toilet stand device provides for accommodating individuals of varying heights. Importantly, the housings are designed to fit typical toilet dimensions such that the front and back sides of the housing are substantially even with a front and back of a toilet. A user is thereby allowed feet placement adjacent to the toilet, as is customary in toilet use, with the provision for raising and lowering the toilet to accommodate that person's height. In order for the device to correctly accommodate shorter statures, the bottom housing is ideally sunken within a given surface such that the toilet begins, without elevation, at a height even with the surface. The individual of greater stature has only to turn on the on/off and then use the up/down control to select a desired height for the toilet. This adjustable height feature is not only important for convenience but may be of key importance to anyone suffering from physical limitations. Height adjustment may be provided by hydraulic power. Height adjustment may be provided by screw jacks.

Of equal importance is that the slideable fit of the top housing walls within the bottom housing bottom walls is sealed against any invasion of liquids, germs, and other undesirable contamination, thereby preventing transferred ailments and also facilitating cleanup.

The coil springs are also important in that they may assist with the weight of the mounted toilet, thereby providing a balance such that the hydraulic jacks are not constantly overloaded and thereby subject to fatigue and future leaks. The device may be provided without the coil springs. The hydraulic jack operation is quiet and smooth. Further, the coil springs assist in retracting the top housing.

Thus has been broadly outlined the more important features of the improved height adjustable toilet stand device so that the detailed description thereof that follows may be better understood and in order that the present contribution to the art may be better appreciated.

An object of the height adjustable toilet stand device is to provide that a toilet's height may be selectively adjusted.

Another object of the height adjustable toilet stand device is to provide electric switch operation.

An added object of the height adjustable toilet stand device is to selectively provide for varying toilet height.

A further object of the height adjustable toilet stand device is to provide a sealed housing to negate bacteria, liquid, and other invasions.

An added object of the height adjustable toilet stand device is to provide spring assisted toilet elevation and retraction to lower height.

And, an object of the height adjustable toilet stand device is to provide hydraulic power.

These together with additional objects, features and advantages of the improved height adjustable toilet stand device will be readily apparent to those of ordinary skill in the art upon reading the following detailed description of presently preferred, but nonetheless illustrative, embodiments of the improved height adjustable toilet stand device when taken in conjunction with the accompanying drawings.

DETAILED DESCRIPTION OF THE DRAWINGS

With reference now to the drawings, and in particular FIGS. 1 through 5 thereof, the principles and concepts of the height adjustable toilet stand device generally designated by the reference number 10 will be described.

Figure 1:
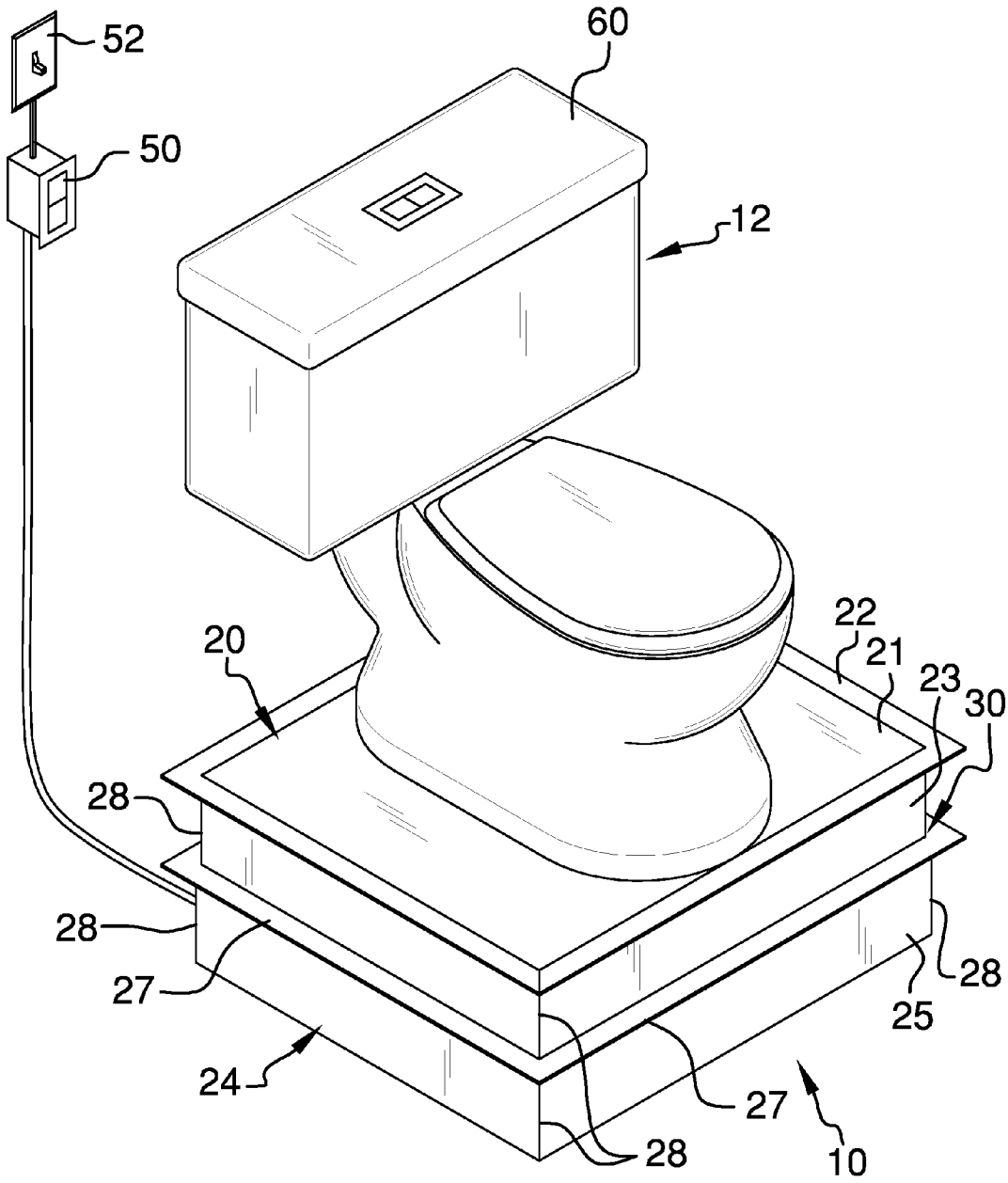
FIG. 1 is a perspective view of the installed device.

Referring to FIG. 1, the device 10 partially comprises the rectangular top housing 20 having four walls 23 joined at corners 28 and a top 21.

Figure 5:
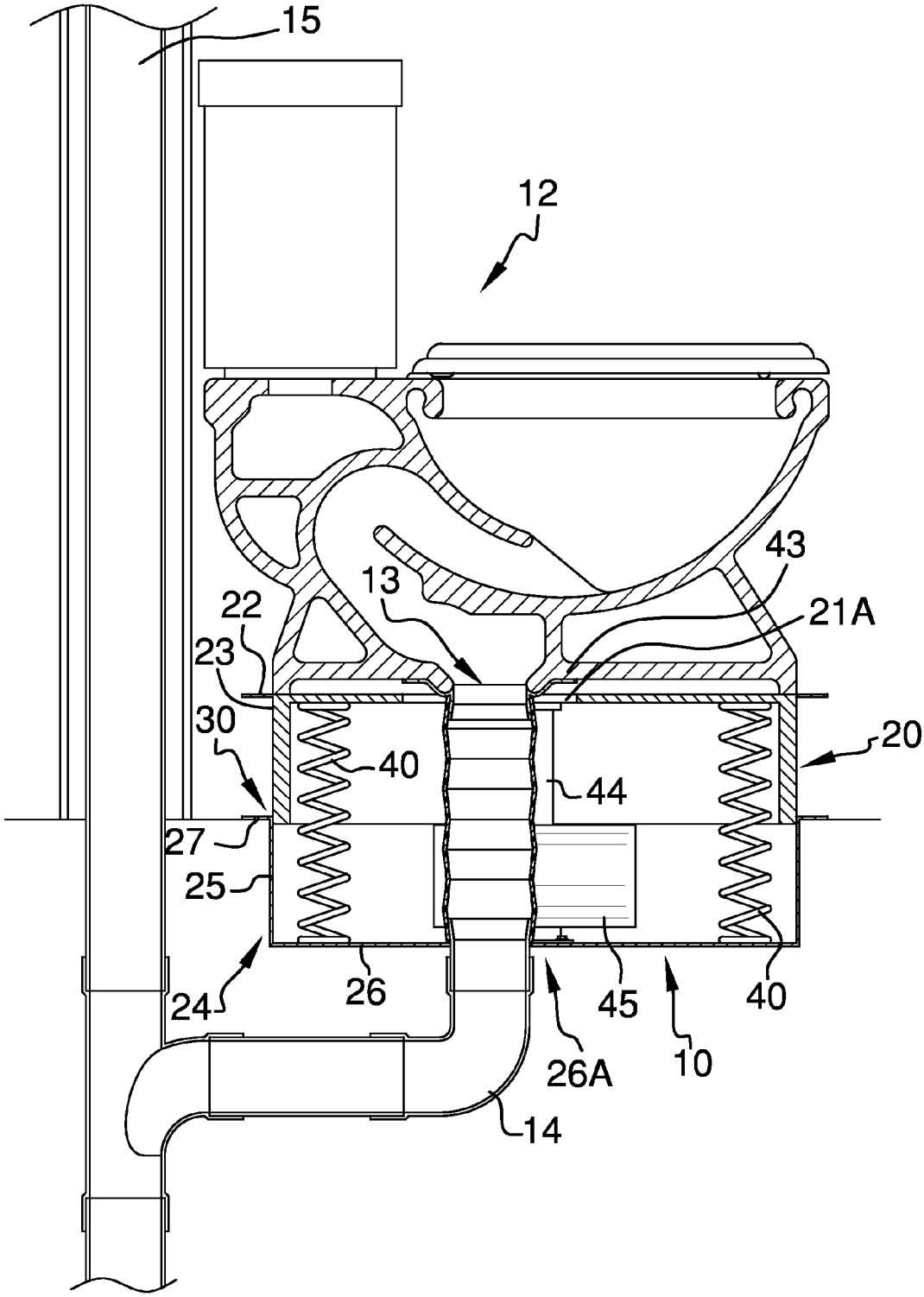
FIG. 5 is a cross sectional view of the installed device, in the fully up position.

Referring to FIG. 5, the top opening 21A is disposed centrally within the top 21. The top flange 22 is extended peripherally from the top 21.

Referring again to FIG. 1, the rectangular bottom housing 24 has bottom walls 25 joined at corners 28. The bottom walls 25 connect the bottom 26.

Figure 2:
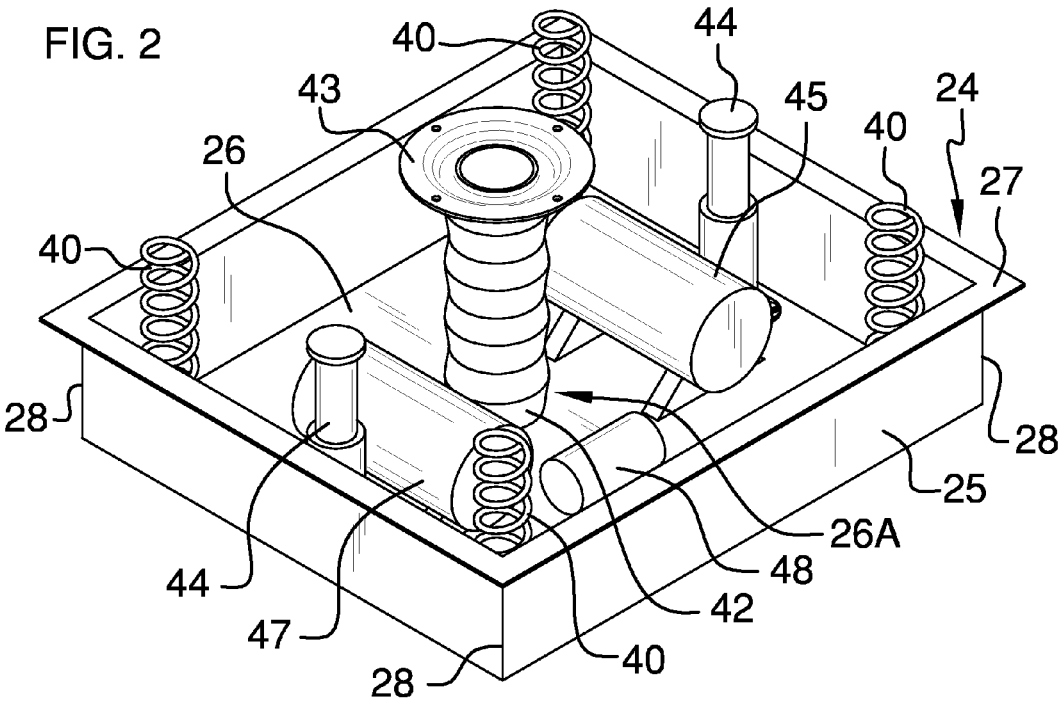
FIG. 2 is a perspective view of the bottom housing and components therein.

Referring to FIG. 2, the sealed opening 26A is disposed centrally in the bottom 26. The upwardly disposed bottom housing flange 27 upwardly and peripherally surrounds the bottom walls 25.

Referring again to FIG. 5, the top housing 20 walls 23 are slideably fitted within the bottom housing 24 bottom walls 25.

Referring to FIG. 5, a seal 30 seals the top housing 20 walls 23 sliding within the bottom walls 25.

Referring to FIG. 2, the plurality of coil springs 40 is disposed upwardly from the bottom 26 of the bottom housing 24. One of each of the coil springs 40 is disposed at one of each of the bottom housing 24 corners 28. The coil springs 40 are in contact with an interior the top housing 20 top 21.

Figure 3:
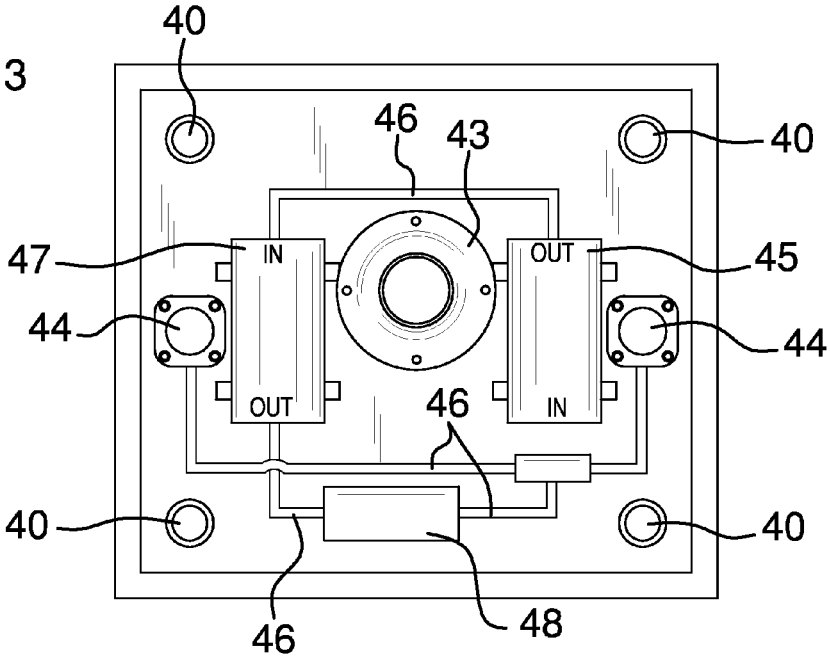
FIG. 3 is a top plan view of the bottom housing.

Referring to FIG. 3, the pair of hydraulic jacks 44 is disposed upwardly from the bottom housing 24 bottom 26. The jacks 44 are diametrically opposed adjacent to opposite bottom walls 25. The jacks 44 are in contact with the top housing 20 top 21 in order to lift and lower the top housing 20 top and thereby raise and lower the existing toilet 12 to a given desired height. The hydraulic pump 47 is in communication with the hydraulic jacks 44. The reservoir 45 is in communication with the hydraulic pump 47. The solenoid 48 is in communication with the pump 47 and the hydraulic jacks 44.

Referring again to FIG. 1, the up/down control 50 is in communication with the solenoid 48. The on/off 52 is in communication with the up/down control 50.

Figure 4:
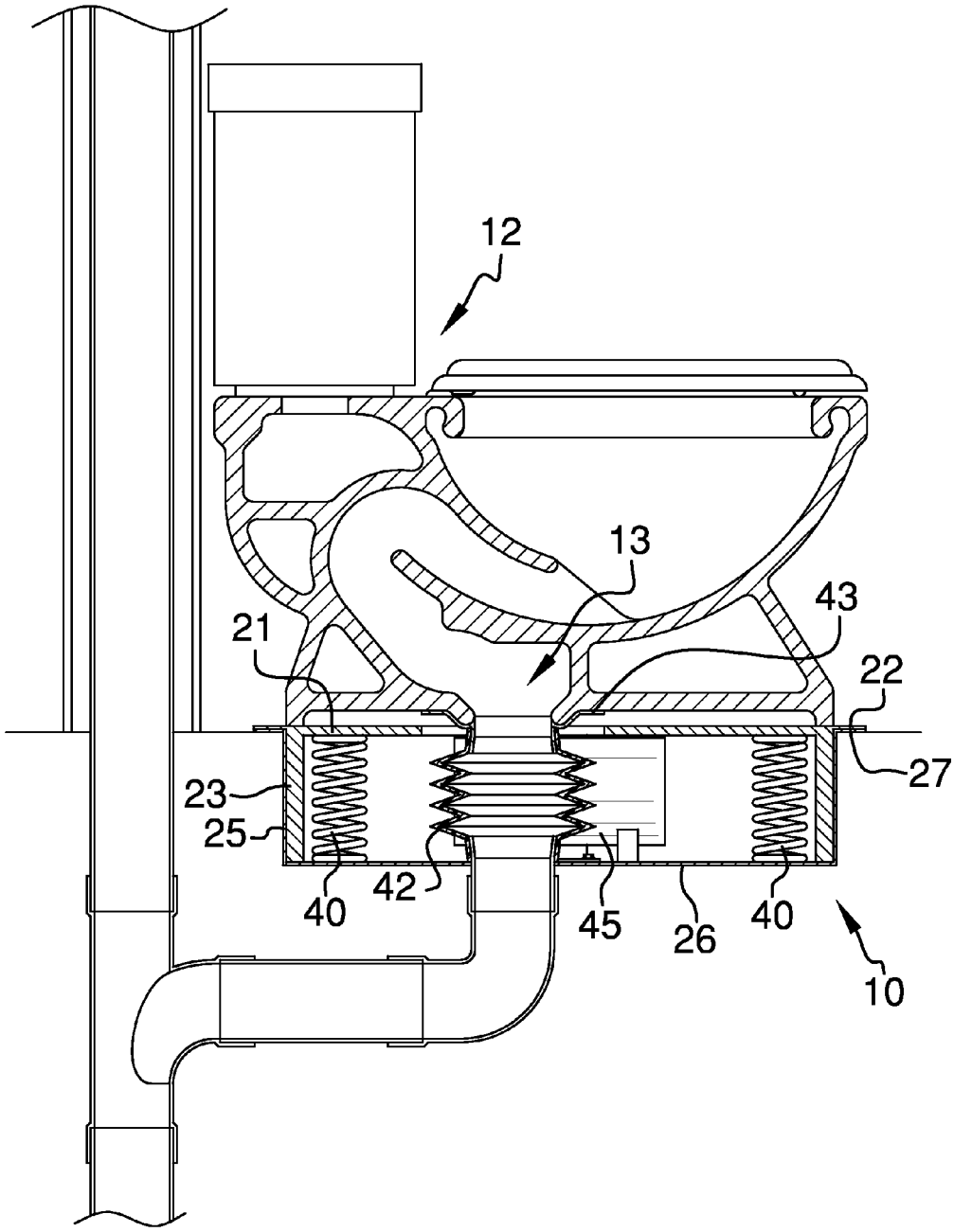
FIG. 4 is a cross sectional view of the installed device, in the fully down position.

Referring to FIGS. 4 and 5, the accordion sewer connection 42 is extended from the top opening 21A to the bottom 26 sealed opening 26A. The toilet flange 43 seals the accordion sewer connection 42 to an existing toilet 12 with toilet drain 13 fitted atop the top housing 20 top 21.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the height adjustable toilet stand device may be used.

What is claimed is:

1. A height adjustable toilet stand device comprising, in combination:

a rectangular top housing having four walls joined at corners, a top, a top opening disposed centrally within the top, and a top flange extended peripherally from the top;

a rectangular bottom housing having bottom walls joined at corners, the bottom walls connecting a bottom, a sealed opening disposed centrally in the bottom, an upwardly disposed bottom housing flange upwardly and peripherally surrounding the bottom walls, the top housing walls slideably fitted within the bottom housing bottom walls;

a seal sealing the top housing walls within the bottom walls;

a pair of hydraulic jacks disposed upwardly from the bottom housing bottom, the jacks diametrically opposed adjacent to opposite bottom walls, the jacks in contact with the top housing top;

a hydraulic pump in communication with the hydraulic jacks;

a reservoir in communication with the hydraulic pump;

a solenoid in communication with the pump and the hydraulic jacks;

a remotely positionable up/down control in communication with the solenoid;

an on/off in communication with the up/down control;

an accordion sewer connection extended from the top opening to the bottom sealed opening;

a toilet flange sealing the accordion sewer connection to an existing toilet fitted atop the top housing top.

2. A height adjustable toilet stand device comprising, in combination:

a rectangular top housing having four walls joined at corners, a top, a top opening disposed centrally within the top, and a top flange extended peripherally from the top;

a rectangular bottom housing having bottom walls joined at corners, the bottom walls connecting a bottom, a sealed opening disposed centrally in the bottom, an upwardly disposed bottom housing flange upwardly and peripherally surrounding the bottom walls, the top housing walls slideably fitted within the bottom housing bottom walls;

a seal sealing the top housing walls within the bottom walls;

a plurality of coil springs disposed upwardly from the bottom of the bottom housing, one of each of the coil springs disposed at one of each of the bottom housing corners, the coil springs in contact with an interior the top housing top;

a pair of hydraulic jacks disposed upwardly from the bottom housing bottom, the jacks diametrically opposed adjacent to opposite bottom walls, the jacks in contact with the top housing top;

a hydraulic pump in communication with the hydraulic jacks;

a reservoir in communication with the hydraulic pump;

a solenoid in communication with the pump and the hydraulic jacks;

a remotely positionable up/down control in communication with the solenoid;

an on/off in communication with the up/down control;

an accordion sewer connection extended from the top opening to the bottom sealed opening;

a toilet flange sealing the accordion sewer connection to an existing toilet fitted atop the top housing top.

3. A height adjustable toilet stand device comprising, in combination:

a rectangular top housing having four walls joined at corners, a top, a top opening disposed centrally within the top, and a top flange extended peripherally from the top, an existing toilet removably fitted atop the top housing top;

a rectangular bottom housing having bottom walls joined at corners, the bottom walls connecting a bottom, a sealed opening disposed centrally in the bottom, an upwardly disposed bottom housing flange upwardly and peripherally surrounding the bottom walls, the top housing walls slideably fitted within the bottom housing bottom walls;

a seal sealing the top housing walls within the bottom walls;

a plurality of coil springs disposed upwardly from the bottom of the bottom housing, one of each of the coil springs disposed at one of each of the bottom housing corners, the coil springs in contact with an interior the top housing top;

a pair of hydraulic jacks disposed upwardly from the bottom housing bottom, the jacks diametrically opposed adjacent to opposite bottom walls, the jacks in contact with the top housing top;

a hydraulic pump in communication with the hydraulic jacks;

a reservoir in communication with the hydraulic pump;

a solenoid in communication with the pump and the hydraulic jacks;

a reservoir lid fitted to the existing toilet, the reservoir lid having an up/down control in communication with the solenoid;

an on/off in communication with the up/down control;

an accordion sewer connection extended from the top opening to the bottom sealed opening;

a toilet flange sealing the accordion sewer connection to an existing toilet fitted atop the top housing top.

* * * * *